US005556188A

United States Patent [19]

Poppenheimer

[11] Patent Number: 5,556,188

[45] Date of Patent: Sep. 17, 1996

[54] WET NICHE LIGHT

[75] Inventor: Charles B. Poppenheimer, La Canada-Flintridge, Calif.

[73] Assignee: GTY Industries, Sylmar, Calif.

[21] Appl. No.: 446,400

[22] Filed: May 22, 1995

Related U.S. Application Data

[62] Division of Ser. No. 221,692, Mar. 31, 1994, Pat. No. 5,483,428, which is a division of Ser. No. 981,014, Nov. 24, 1992, Pat. No. 5,349,505.

[51] Int. Cl.[6] ..... F21V 25/00

[52] U.S. Cl. ..... 362/101; 362/147; 362/267; 362/364; 362/375; 362/376

[58] Field of Search ..... 174/51; 439/92, 439/94, 95, 96, 97, 101, 607; 362/96, 101, 147, 149, 267, 364, 375, 376

[56] References Cited

U.S. PATENT DOCUMENTS 3,951,488 4/1976 Hesse et al. ..... 439/94
4,082,940 4/1978 Knowles et al. ..... 439/95
4,620,061 10/1986 Appleton ..... 174/51

*Primary Examiner*—Denise L. Gromada
*Assistant Examiner*—Alan B. Cariaso
*Attorney, Agent, or Firm*—Lyon & Lyon

[57] ABSTRACT

A wet niche light having a nonconductive forming shell 14 with a nonconductive housing 16 mounted therein. A double ended lamp is fixed within the housing in sockets which do not retain the lamp in friction engagement but rather hold the lamp by axial compression. A conductive reflector extends over the sockets and is grounded externally. A planar lens having vertical ribs is positioned within a bezel that attaches to the forward side of the housing by means of resilient clips. The nonconductive forming shell includes a conductive ring about the front opening of the shell with a conductor extending rearwardly for coupling with a pool grounding net. The lamp is positioned far enough within the housing such that no direct light from the lamp will strike the surface of the water in the pool at less than the critical angle of total reflection. The interior of the housing includes a lower portion painted in black such that light will not be reflected therefrom to strike the water surface at an angle less than the critical angle of total reflection.

3 Claims, 6 Drawing Sheets

WET NICHE LIGHT

This application is a division of application Ser. No. 08/221,692, filed Mar. 31, 1994 which issued as U.S. Pat. No. 5,483,428 on Jan. 9, 1996 which is a division of application Ser. No. 07/981,014, filed Nov. 24, 1992, which issued as U.S. Pat. No. 5,349,505 on Sep. 20, 1994.

BACKGROUND OF THE INVENTION

The field of the present invention is underwater lighting for pools and the like.

Swimming pools are subject in most jurisdictions to restrictive codes directed to the avoidance of electrical shock. Most typically, all conductive elements associated with the pool are to be grounded to a conductive net provided about the pool. This includes lighting fixtures. Additionally, powered fixtures are to be grounded to the electrical panel from which current is obtained for running the fixture such as a pool light.

A main pool light typically includes a conductive forming shell which is integrally associated with the structure of the pool and is electrically grounded to the pool grounding net. This conductive forming shell forms a niche in the side of the pool for receipt of a light housing. Such shells are typically displaced from an associated light housing with free water flow into the niche defined by the shell. The water admitted between the housing and the shell is used to cool the light.

Typical light housings are sealed with a lamp contained therein, a lens covering a front opening and a bezel about the lens which covers the periphery of the niche for aesthetic purposes and mounts the housing to the forming shell. The housings are typically conductive and have a ground wire extending as part of a cable through the forming shell and to the junction box. The conductive housing is also in electrical communication with the forming shell through the bezel and in turn with the pool grounding net.

Failure considerations in defining codes include the prospect of the lens being broken. Under such circumstances, electrical potential lines in the pool water are understood to form fields much like magnetic field lines. The metallic housing, bezel and forming shell all act to constrain the electric field and prevent shock to anyone nearby. The grounding through the net is further intended to prevent shock when someone comes in contact with another conductive element in the pool, such as a ladder or drain.

SUMMARY OF THE INVENTION

The present invention is directed to a wet niche light for a pool.

In a further aspect of the present invention, a nonconductive forming shell is associated with a lamp to define a pool niche. A conductive ring is employed about the front opening of the forming shell and also extends rearwardly as a strap to a terminal through the nonconductive forming shell. This makes grounding of the conductive ring to the pool net possible. This arrangement further provides confinement of any electric field as well as a conventional terminal for shell grounding.

Accordingly, it is an object of the present invention to provide an improved wet niche light. Other and further objects and advantages will appear hereinafter.

DETAILED DESCRIPTION OF THE PREFERRED EMBODIMENT

Figure 1:
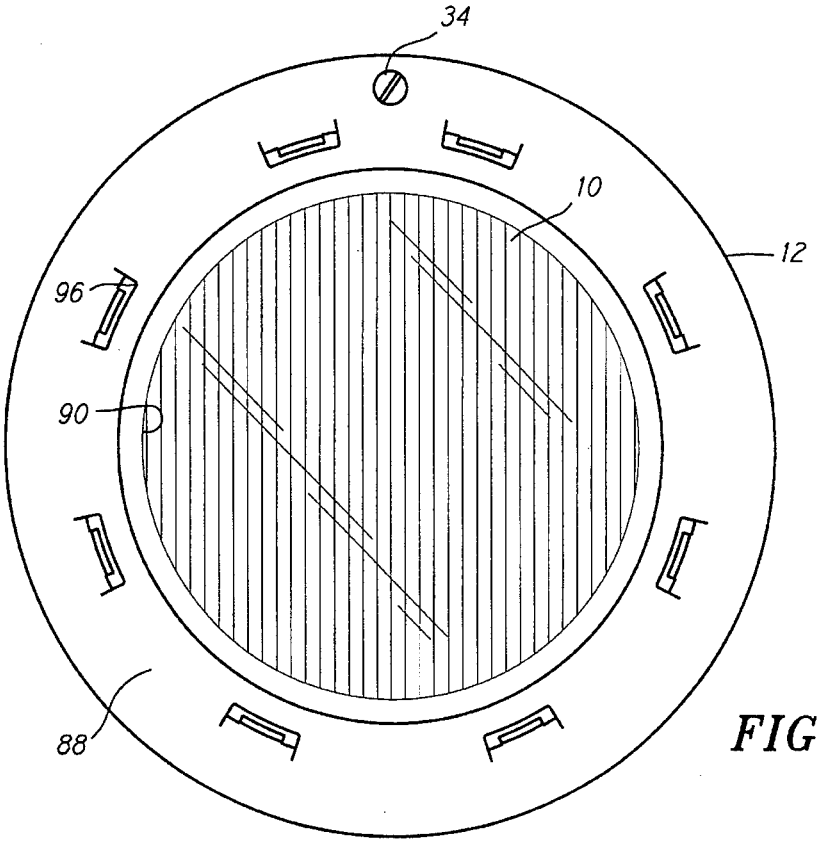
FIG. 1 is a front view of a light of the present invention.
Figure 2:
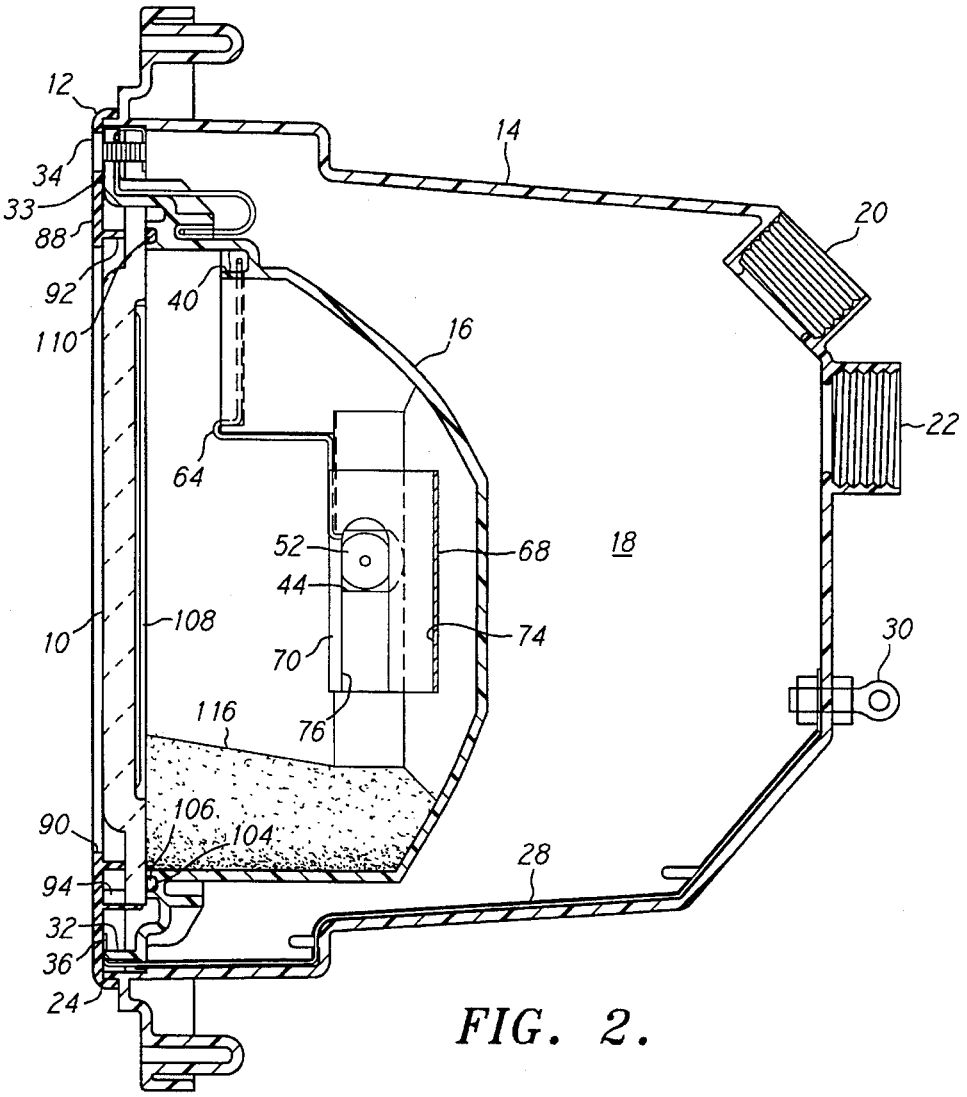
FIG. 2 is a vertical cross-sectional view of the light including the housing and forming shell.
Figure 6:
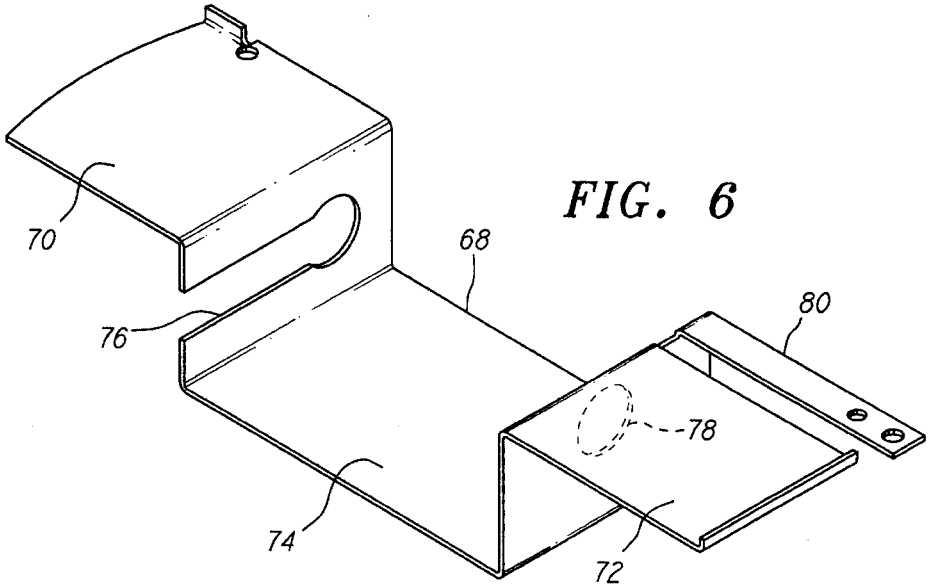
FIG. 6 is a perspective view of the conductive shield.
Figure 3:
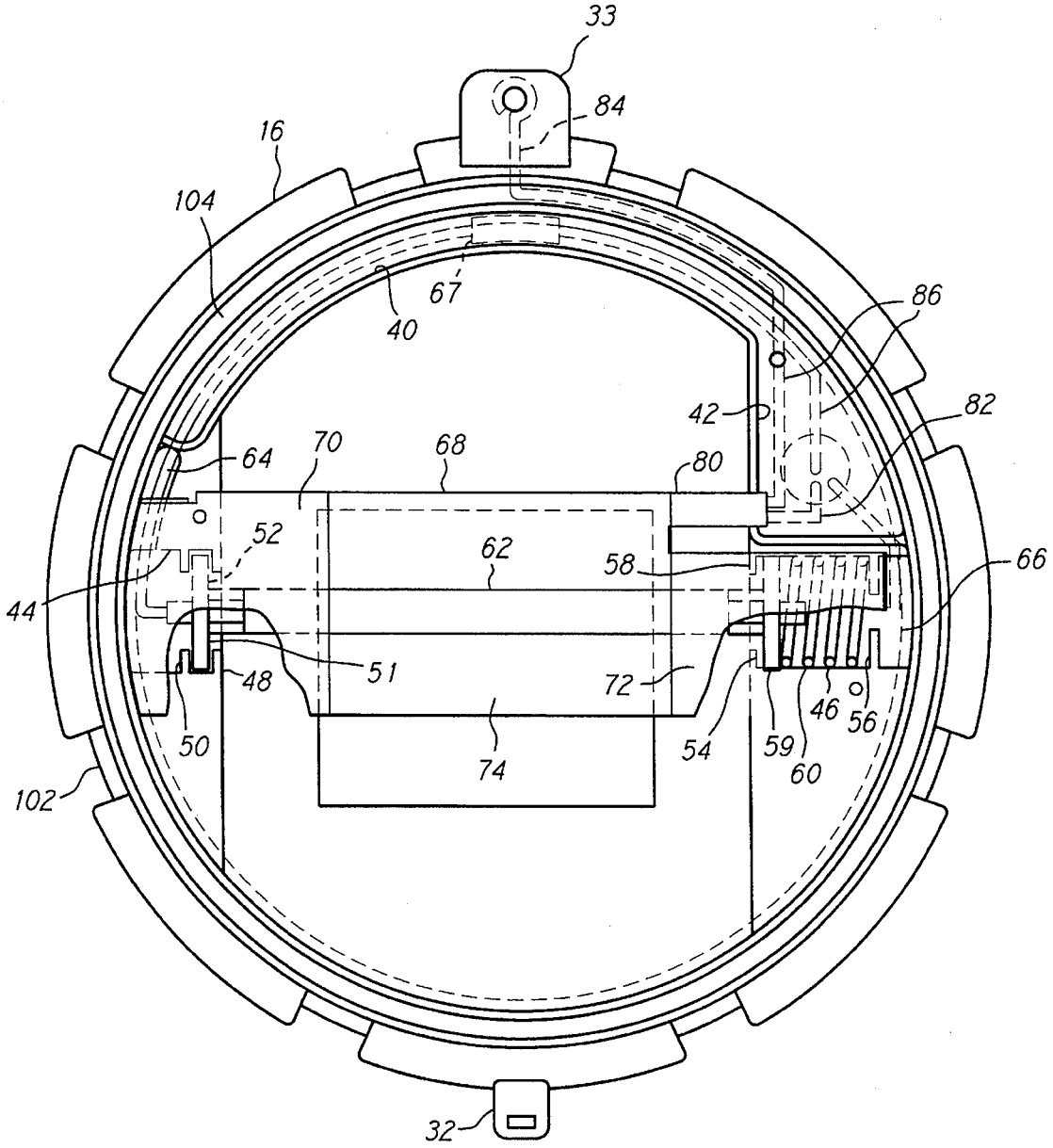
FIG. 3 is a front view of the housing with the bezel and lens removed.

Turning in detail to the drawings, FIG. 1 illustrates a niche light for swimming pools as it would be viewed from the pool. A lens 10 is illustrated to be surrounded by a bezel 12. The construction of the light is better illustrated in FIG. 2 as further including a nonconductive forming shell 14 and a nonconductive housing 16. The forming shell 14 defines a niche 18 having a front opening lying substantially in a vertical plane as it is arranged in the pool. Threaded ports 20 and 22 may be plugged or may include grommets for receipt of electrical conduit extending from the pool to a junction box. The front opening of the nonconductive forming shell 14 is generally circular.

Figure 9:
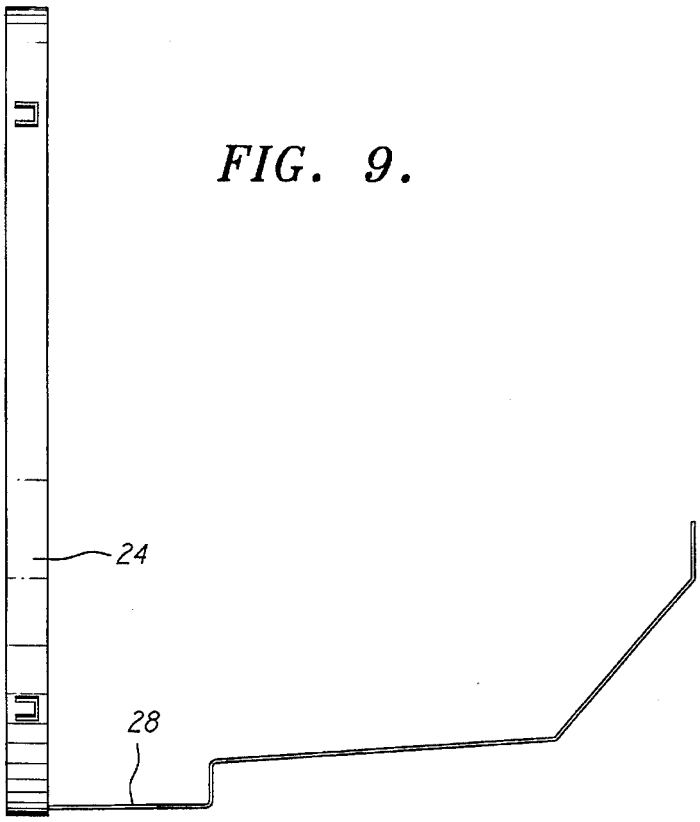
FIG. 9 is a side view of the conductive ring.
Figure 10:
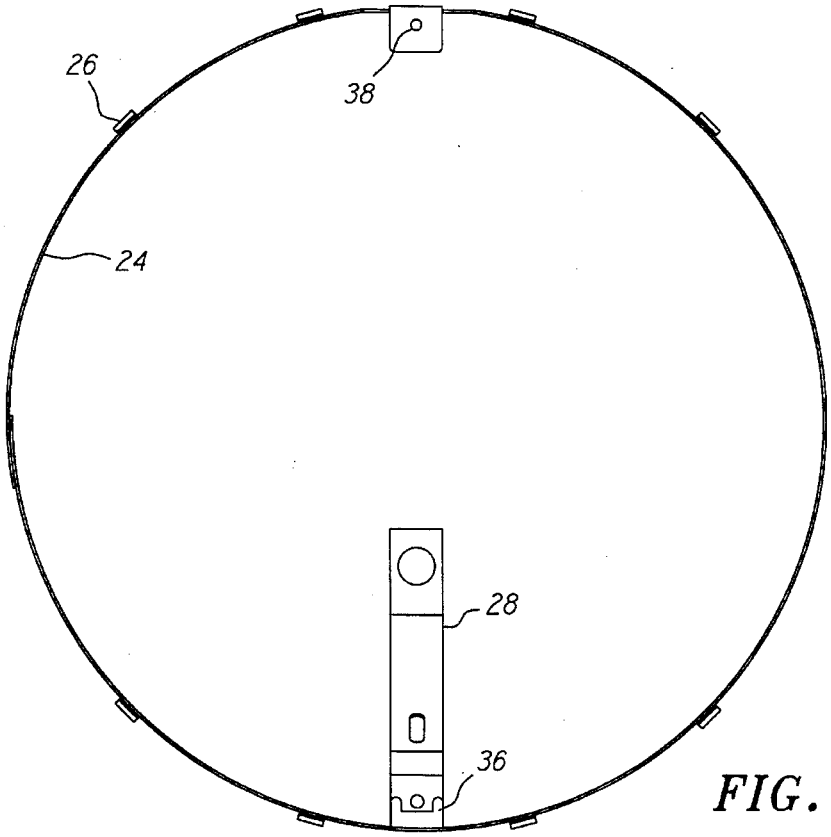
FIG. 10 is a front view of the conductive ring.

FIGS. 9 and 10 provide the details of a conductive ring 24 which is pressed into the inner periphery of the nonconductive forming shell 14 at the front opening. Anchors 26 press outwardly against the nonmetallic shell and lock the conductive ring 24 in place. A strap 28 extends rearwardly into the shell 14 from the conductive ring 24. A terminal 30 is bolted to the shell 14 for attachment to the grounded pool net.

The nonconductive housing 16 is water tight but for a front opening also lying in a vertical plane as positioned in the pool. The housing 16 is spaced from the nonconductive forming shell 14 in order that water may fully surround the housing 16 and provide cooling thereto.

The housing includes a foot 32 which extends downwardly from the bottom thereof. At the upper end of the housing 16, a tab 33 having a hole therethrough provides for receipt of a fastening bolt 34. The foot 32 and the bolt 34 engage a stop 36 and a threaded hole 38, respectively, arranged on the conductive ring 24. As the conductive ring 24 is securely positioned within the shell 14 by means of the anchors 26, the stop 36 and hole 38 securely retain the housing 16 and yet allow the bolt 34 to be removed for relamping.

The interior of the housing 16 includes a channel 40 extending partially about the cavity. At one end of the channel 40, a potting cavity 42 is positioned to receive conductive elements from externally of the housing. Two socket cavities 44 and 46 are provided on either side of the main cavity of the housing 16. In a first socket cavity 44, a retaining slot is defined by two inwardly extending flanges 48 and 50 spaced to receive a square positioning flange 51 on a socket 52. The other socket cavity 46 also includes inwardly extending flanges 54 and 56 which are spaced further apart than the flanges 48 and 50 so as to receive a square positioning flange 59 on a socket 58 and a spring 60. The spring 60 is placed in compression so as to bias the socket 58 inwardly within the housing 16. The sockets 52 and 58 are aligned to define an axis therebetween for receipt of a double ended lamp 62. The lamp is to be of sufficient length to place the spring 60 in added compression through movement of the socket 58 to accommodate the lamp. The sockets 52 and 58 are preferably designed so that the double ended lamp 62 is held in place by compression and does not have the ends of the lamp held in frictional engagement. In this way, if the lamp 62 is ever broken, the two or more fragments will fall from the sockets 52 and 58 so as to cease to conduct electricity under such a failure mode.

Within the housing 16, a first conductor 64 extends from the socket 52 around the channel 40 to the potting cavity 42. A second conductor 66 extends from the socket 58 into the potting cavity 42. In the conductor 64, a thermostat 67 is positioned which ceases to conduct above a selected temperature. Consequently, if the lamp is on without water around the housing 16, the accumulated heat will cause the thermostat to actuate and turn off the lamp.

A conductive shield 68 is positioned within the housing 16 so as to shield the sockets 52 and 58. The conductive shield may be considered as three portions with two outward portions 70 and 72 covering the sockets and a central, reflective portion 74. The outward, socket portions 70 and 72 each extend over a socket and then extend inwardly within the housing 16 to meet the reflective portion 74 located behind the lamp 62. Holes 76 and 78 provide for placement of the double ended lamp 62. The conductive shield 68 may conveniently be of highly reflective metal sheet so as to reflect a maximum amount of the light emanating from the lamp 62 outwardly into the pool. A connector 80 forming part of the conductive shield 68 extends to the potting cavity 42 where it is coupled with a ground conductor 82.

Extending from the potting cavity 42 outwardly to the hole in the housing 16 for receiving the bolt 34 is a rigid ground conductor 84. This rigid conductor 84 is connected at one end to the connector 80. This connection in turn provides a ground to the ground conductor 82 extending to the junction box and, ultimately, to an electrical panel. At its other end, the rigid conductor 84 is associated with the bolt 34 that is threaded into the hole 38 of the conductive ring 34. Thus, a separate grounding to the pool net is provided. Holes are provided through the wall of the housing 16 at the potting cavity 42 in order that the rigid conductor 84 may pass therethrough as well as a conduit containing the conductors 64 and 66 and the grounded conductor 82. A potting body 86 is then poured and solidified into the potting cavity 42 as well as the channel 40.

Figure 4:
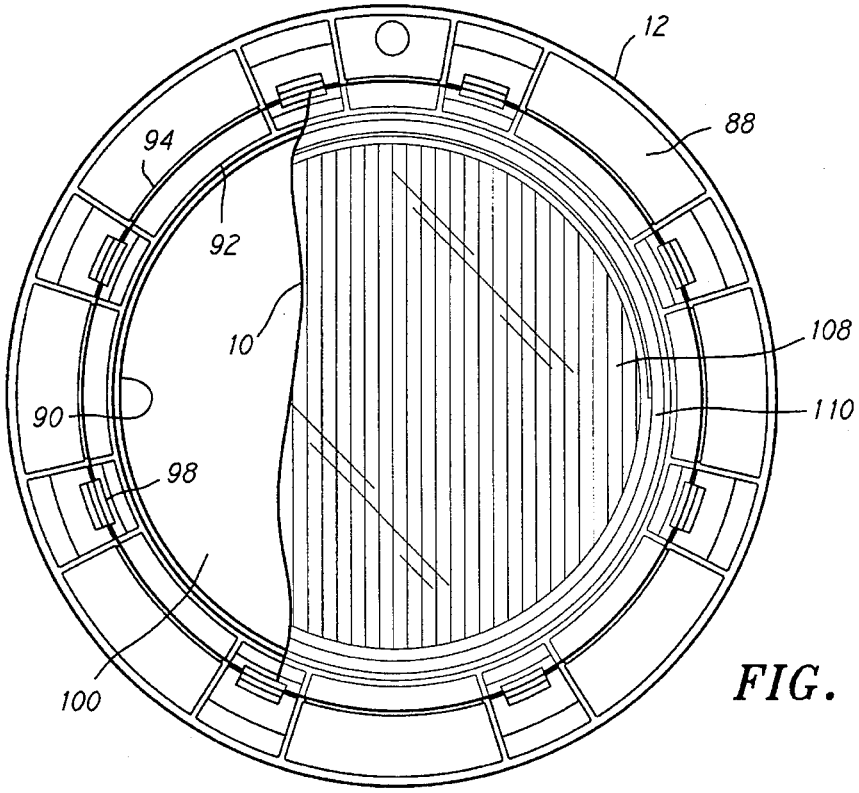
FIG. 4 is a back view of the lens and bezel assembly.
Figure 5:
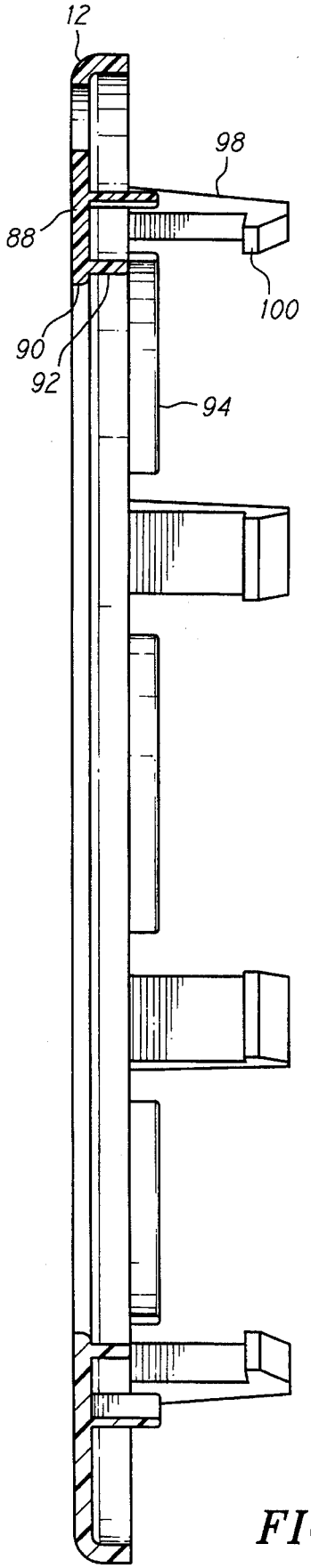
FIG. 5 is a cross-sectional side view of the bezel.
Figure 7:
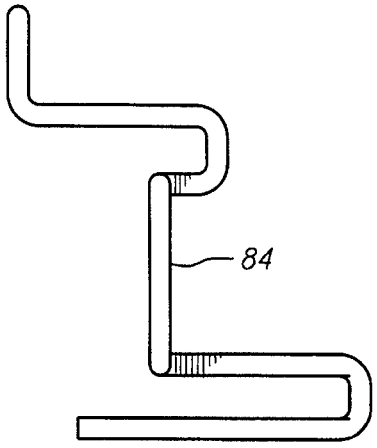
FIG. 7 is a side view of a rigid grounding conductor.
Figure 8:
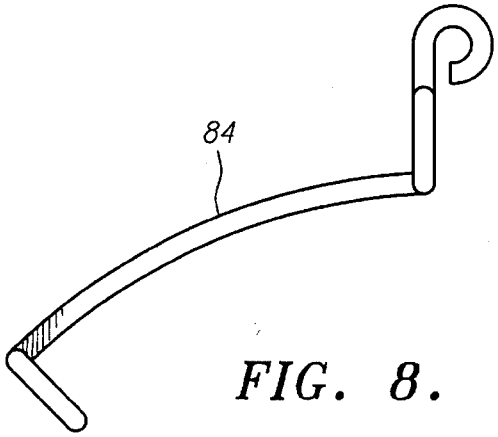
FIG. 8 is a back view of the rigid grounding conductor.

The bezel 12 is best illustrated in FIGS. 4 and 5. The bezel 12 includes a circular body 88 having a central hole 90 therethrough. A rearwardly extending flange 92 which is cylindrical in form defines a seat for the lens 10. Outwardly of the flange 92 are flange segments 94 which extend further rearwardly on the bezel 12 to further define the seat for the lens 10 which fits therein. In the circular body 88, circulation holes 96, as best seen in FIG. 1, communicate with the interior of the shell 14 defining the niche.

Also extending rearwardly from the bezel 12 are clips 98. Each clip 98 is a resilient leg extending rearwardly on the bezel with an interlocking portion 100. The housing 16 includes outwardly extending flanges 102 to which the interlocking portions 100 may resiliently pass over when the bezel 12 is pressed against the front of the housing 16 and come into interlocking engagement.

The front of the housing 16 includes a sealing channel 104 which contains an O-ring 106. The O-ring 106 is compressed by the lens 10 when the bezel and lens assembly is positioned and interlocked on the housing 16.

The lens 10 is preferably planar with means for further refracting light in other than on upward direction, e.g., horizontally and downwardly to this end, vertically arranged dispersion ribs 108 are on the back side of the lens 10. The vertically arranged ribs 108 spread light horizontally from the lamp 62. A smooth circular rim 110 about the lens 10 provides a seat against the O-ring 106. A strip of opaque material extends 180° about the junction between the main portion of the lens 10 and the rim 110 to prevent a vertical dispersion of light at that junction.

Figure 11:
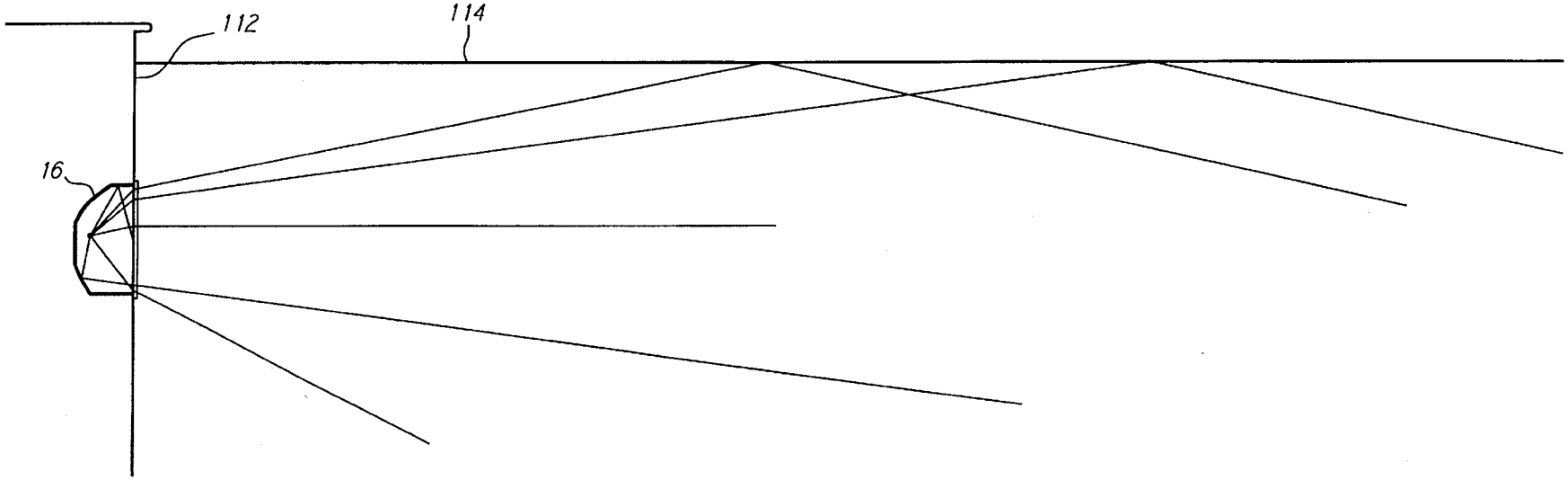
FIG. 11 is a diagrammatic view of a pool illustrating light rays from a fixture of the present invention.

Turning to FIG. 11, an optical system is illustrated which prevents the light image from the wet niche light from directly being observed above the pool. The pool wall 112 is schematically illustrated as supporting a housing 16. Light from the lamp 62 is shown to be refracted through the lens 10 into the pool. The lamp 62 is positioned rearwardly in the housing 16 away from the lens 10 to an extent that the maximum upward angle of light exiting from the lens 10 is below the critical angle of total reflection at the water-to-air boundary 114. The use of a planar lens and only vertical ribs allows for horizontal but not vertical dispersion of the light through the lens to insure further the appropriate angle. To further reduce creation of an image of the light on the surface, the lower portion 116 of the interior of the housing 16 may be painted black or otherwise configured such that light does not reflect directly from the lamp 62 onto the lower surface of the interior portion of the housing and through the lens.

An angle of incidence is the angle a ray makes with a normal to the surface at the point of intersection of the ray with that surface. For a water-to-air boundary, an angle of incidence of 48.5° or more will cause total reflection of the light at that surface. To simply meet this critical angle of total reflection, light emanating from the lens 10 placed at 90° to the surface of the water is to have an upward angle of refraction, i.e., the angle between a light path extending upwardly from the lens 10 and a horizontal plane including the point of exit of the light path from the lens 10, which is no more than 41.5°. Because of the air-to-glass and glass-to-water boundaries at the lens 10, the upward angle of incidence from the lamp 62, i.e., the angle between a light path extending upwardly from the lamp 62 and a horizontal plane including the source of light from the lamp 62, to any portion of the lens 10 which can transmit light, is not to exceed slightly over 62°. These angles assume a flat water surface.

At the same time, the principal objective is to disperse light into the pool. With the vast majority of pools, light dispersion from a single pool light is virtually complete throughout the pool even with a maximum angle of incidence on the lens 10 from the lamp 62 of much less than the critical angle of 62°.

To reduce flashing of light from the pool resulting from waves and ripples, the upward angle of incidence by light from the lamp 62 against the lens which can pass through the lens 10 has been reduced to a maximum of approximately 42°. A 42° maximum upward angle of incidence from the lamp 62 to the lens 10 results in a 30° maximum upward angle of refraction at the glass-to-water boundary. This gives a minimum angle of incidence at the water-to-air surface of the pool, when flat, of 60°, 11.5° over the critical angle of total reflection. Fixture misalignment and some waves are thereby accommodated. The maximum downward and lateral angles of refraction may intentionally far exceed the maximum upward angle to insure full illumination of the pool. This configuration has been found to provide adequate light dispersion in the conventional swimming pool, eliminate viewing of an image of the pool light from above the water surface and reduces flashing at surface ripples to an aesthetically pleasing effect. The effect generally appears to be light flashes at the surface rather than the image of a pool light below the surface.

Thus, an improved wet niche pool light is here described. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A wet niche light comprising an electrically nonconductive forming shell including a front opening;

an electrically nonconductive housing mounted within and spaced from said electrically nonconductive forming shell and being received through said front opening;

one or more lamp sockets mounted in said housing;

an electrically conductive ring extending about said front opening and including an electrically conductive strap extending away from said front opening; and a terminal extending through said electrically nonconductive forming shell and being electrically coupled with said strap.

2. The wet niche light of claim 6 wherein said conductive ring further includes a mount for said housing at said front opening.

3. A wet niche light comprising an electrically nonconductive forming shell including a first front opening;

an electrically nonconductive housing including a second front opening, said housing being mounted within and spaced from said electrically nonconductive forming shell and being received through said first front opening;

a lens positioned across said second front opening;

a seal between said lens and said housing;

an electrically conductive ring extending about said first front opening and including an electrically conductive strap extending away from said first front opening; and a terminal extending through said electrically nonconductive forming shell and being electrically coupled with said strap.

* * * * *